US011125241B2

(12) United States Patent
Horng et al.

(10) Patent No.: US 11,125,241 B2
(45) Date of Patent: Sep. 21, 2021

(54) CEILING FAN

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Chung-Hao Tsai, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 159 days.

(21) Appl. No.: 16/548,111

(22) Filed: Aug. 22, 2019

(65) Prior Publication Data

US 2020/0173446 A1 Jun. 4, 2020

(30) Foreign Application Priority Data

Nov. 30, 2018 (TW) ..... 107142994
Dec. 12, 2018 (TW) ..... 107144787

(51) Int. Cl.

*F04D 25/08* (2006.01)
*F04D 29/40* (2006.01)
*F21V 33/00* (2006.01)
*F04D 29/18* (2006.01)

(52) U.S. Cl.

CPC ..... *F04D 25/088* (2013.01); *F04D 29/40* (2013.01); *F21V 33/0096* (2013.01); *F04D 29/18* (2013.01)

(58) Field of Classification Search

CPC ..... F04D 25/088; F21V 33/0096
See application file for complete search history.

(56) References Cited

U.S. PATENT DOCUMENTS 2,695,950 A 11/1954 Zingone
6,244,820 B1 * 6/2001 Yilmaz ..... F04D 25/088 416/146 R
9,810,227 B2 * 11/2017 Gajewski ..... F04D 25/088
10,429,060 B2 10/2019 Horng et al.
2016/0348894 A1 12/2016 Horng et al.

FOREIGN PATENT DOCUMENTS

CN 205248924 U 5/2016

* cited by examiner

*Primary Examiner* — Woody A Lee, Jr.
*Assistant Examiner* — Brian O Peters
(74) *Attorney, Agent, or Firm* — Alan D. Kamrath; Karin L. Williams; Mayer & Williams PC

(57) ABSTRACT

A ceiling fan includes a support unit, a stator, a rotor and a lamp. The support unit includes an axle and a magnetic disc fit around the axle. The stator is fit around the axle. The rotor has a plurality of blades rotatably mounted to the axle. The lamp includes a housing and a light emitting portion below a magnetic top face of the housing. The magnetic top face of the housing is attracted to the magnetic disc.

17 Claims, 10 Drawing Sheets

FIG. 3

CEILING FAN

CROSS REFERENCE TO RELATED APPLICATION

The application claims the benefit of Taiwan application serial Nos. 107142994 and 107144787, respectively filed on Nov. 30, 2018 and Dec. 12, 2018, and the subject matters of which are incorporated herein by reference.

BACKGROUND OF THE INVENTION

1. Field of the Invention

The present invention generally relates to a ceiling fan and, more particularly, to a ceiling fan including a lamp.

2. Description of the Related Art

FIG. 1 shows a conventional ceiling fan 9 including a stator 91 and a rotor 92. The stator 91 includes an axle 911. A threaded portion 912 forms at one end of the axle 911. The rotor 92 includes a plurality of blades and is coupled with the outer periphery of the axle 911. The stator 91 can drive the blades of the rotor 92 to rotate. The threaded portion 912 is configured to couple with a lamp 93 to thereby provide the ceiling fan 9 with an air-guiding function and an illumination function.

The lamp 93 includes a seat 93*a* and a lampshade 93*b*. During the assembly, the seat 93*a* is fit around the threaded portion 912 of the axle 911 through the central hole of the seat 93*a*. Then, a fastener 931 is threaded through the threaded portion 912 below the seat 93*a*, thereby clamping and fixing the seat 93*a* in place. Finally, the lampshade 93*b* is mounted to the seat 93*a* to complete the assembly procedure. In such a case, various parts of the lamp 93 need to be individually assembled in the installation site, leading to a complex assembly procedure and an inconvenient installation work. The de-installation is also inconvenient when repair or maintenance is required.

In light of this, it is necessary to improve the conventional ceiling fan.

SUMMARY OF THE INVENTION

It is therefore the objective of this invention to provide a ceiling fan with a simplified assembly procedure.

It is another objective of this invention to provide a ceiling fan which enables the installer to properly mount the lamp to a predetermined location of the ceiling fan when it is hardly possible for the installer to view the internal structure of the ceiling fan.

It is a further objective of this invention to provide a ceiling fan which permits the lamp that is mounted to the ceiling fan to have a reduced axial height.

It is yet a further objective of this invention to provide a ceiling fan which ensures that its magnets will not drop from the bottom of the ceiling fan.

In an aspect, a ceiling fan includes a support unit, a stator, a rotor and a lamp. The support unit includes an axle and a magnetic disc fit around the axle. The stator is fit around the axle. The rotor has a plurality of blades rotatably mounted to the axle. The lamp includes a housing and a light emitting portion below a magnetic top face of the housing. The magnetic top face of the housing is attracted to the magnetic disc.

According to the above, the lamp of the ceiling fan of the present invention can be pre-assembled. The pre-assembled lamp can be brought to the installation site and the top portion of the lamp can be quickly mounted to the magnetic disc through the force of attraction to efficiently complete the assembly. This reduces not only the quantity of the parts requiring assembly but also the time consumption resulting from the assembly of said parts. As a result, the efficiency and convenience in assembly are greatly improved. In this regard, when the lamp requires repair or maintenance, the lamp can be quickly removed from the ceiling fan to thereby accomplish the advantage such as efficient replacement or maintenance.

In a form shown, the magnetic disc includes a disc portion coupled with the axle and at least one magnet coupled with the disc portion of the magnetic disc. Based on this, the magnetic disc has a simple structure which allows for easy manufacture, thereby reducing the manufacturing cost and improving the convenience in manufacture.

In the form shown, the disc portion of the magnetic disc is non-circular. Based on this, the disc portion can be readily engaged with the axle.

In the form shown, a first threaded portion is provided at an end of the axle. The magnetic disc includes an extension tube connected to a center of the magnetic disc on a face of the magnetic disc facing the axle. The extension tube includes a second threaded portion threadedly engaged with the first threaded portion of the axle. Based on this, the threaded engagement between the disc portion and the axle is reinforced.

In the form shown, the axle includes a shoulder portion adjacent to the first threaded portion of the axle, and an elastic member is sandwiched between a top of the extension tube and the shoulder portion of the axle. Based on this, the engagement between the disc portion and the axle is further reinforced.

In the form shown, the disc portion has a hole. A reduction portion forms between the hole and the extension tube. The reduction portion is coaxial with the extension tube and is at an end of the second threaded portion of the extension tube. An elastic member is sandwiched between the reduction portion and a bottom end face of the axle. Based on this, the engagement between the disc portion and the axle is further reinforced.

In the form shown, the disc portion is connected to an end of the extension tube to form a blind hole of the extension tube. The elastic member is disposed in the extension tube and is sandwiched between the bottom end face of the axle and a bottom face of the extension tube. Based on this, the engagement between the disc portion and the axle is further reinforced.

In the form shown, the disc portion has a top face and a bottom face opposite to the top face, and the magnetic top face of the lamp abuts the bottom face of the disc portion of the magnetic disc. Based on this, the lamp can be securely mounted to the disc portion to thereby reduce the entire axial height of the engaged magnetic disc and lamp.

In the form shown, the at least one magnet does not protrude from the top face or the bottom face, and each of the at least one magnet has a bottom spaced from the bottom face of the disc portion at a minimum axial distance of 0.3-0.7 mm. Based on this, the entire axial height of the engaged magnetic disc and lamp can be reduced while the at least one magnet exhibits a sufficient force to properly attract the lamp.

In the form shown, the disc portion forms at least one receiving space on the top face for installation of the at least one magnet, and the at least one receiving space extends from the top face towards but spaced from the bottom face of the magnetic disc. Based on this, it can be ensured that the at least one magnet will not drop from the bottom of the disc portion after the at least one magnet is mounted in the at least one receiving space.

In another form shown, the disc portion forms at least one receiving space on the bottom face for installation of the at least one magnet, and the at least one receiving space extends from the bottom face towards but spaced from the top face of the magnetic disc. This permits the use of the at least one magnet with a weaker force to thereby reduce the cost of the ceiling fan.

In a further form shown, the disc portion forms at least one receiving space extending through the disc portion from the top face to the bottom face. A shoulder portion forms in each of the at least one receiving space. Each of the at least one magnet is installed in a respective one of the at least one receiving space and abuts the shoulder portion. Based on this, it can be ensured that the at least one magnet will not drop from the bottom of the disc portion after the at least one magnet is installed in the at least one receiving space while reducing the weight of the disc portion.

In the form shown, an outer periphery of the disc portion includes a tapering portion tapering towards the bottom face. Based on this, the lamp can be smoothly guided to engage with the disc portion, thus improving the convenience in installation of the lamp.

In the form shown, the rotor has an installation opening. The lamp includes a guiding protrusion connected to and protruding from the magnetic top face. The installation opening is spaced from the bottom face of the magnetic disc at an axial distance. The guiding protrusion protrudes from the magnetic top face by a maximum axial height larger than the axial distance. Based on this, when the top portion of the lamp passes through the installation opening of the rotor, the guiding protrusion will make contact with the magnetic disc before the magnetic top face makes contact with the magnetic disc. In this arrangement, the installer can smoothly proceed with the installation of the lamp under the guidance of the guiding protrusion without being able to view the magnetic disc, mounting the lamp to the bottom of the ceiling fan at the central position. Therefore, the convenience and efficiency in assembly of the ceiling fan are improved.

In the form shown, the rotor includes a decorative cover forming the installation opening. The installation opening has a diameter larger than a diameter of the magnetic top face of the housing but smaller than a width of a bottom of the light emitting portion. Based on this, the user will not see the internal structure of the lamp when viewed from the bottom up. Thus, the ceiling fan looks better and can prevent the intrusion of the dust.

In the form shown, the guiding protrusion is in a form of a ring connecting to and protruding from the magnetic top face of the housing. The ring includes an annular wall delimiting a compartment. The magnetic disc is received in the compartment. Based on this, the lamp has a simple structure which allows for easy manufacture, thereby reducing the manufacturing cost and improving the convenience in manufacture.

In the form shown, the annular wall is coupled with the magnetic disc by a transition fit or a loose fit. Based on this, the magnetic disc can be smoothly disposed in the compartment, improving the convenience in assembly.

In the form shown, the compartment has a portion away from the magnetic top face and in an expanding form. Based on this, the magnetic disc can be smoothly disposed in the compartment, improving the convenience in assembly.

In the form shown, the axle is hollow. The guiding protrusion is a plug engaging with and protruding beyond the magnetic top face. The plug is inserted into a hole of the axle or the magnetic disc. Based on this, the lamp has a simple structure which allows for easy manufacture, thereby reducing the manufacturing cost and improving the convenience in manufacture.

In the form shown, the plug has a portion away from the magnetic top face and in a tapered form. Based on this, the plug can be smoothly inserted into the axle or the magnetic disc.

In the form shown, the guiding protrusion is in a form of a plurality of bent plates integrally connected to the magnetic top face, and the plurality of bent plates delimits a compartment receiving the magnetic disc. Based on this, the lamp has a simple structure which allows for easy manufacture, thereby reducing the axial height of the lamp and reinforcing the engagement between the lamp and the magnetic disc.

In the form shown, the plurality of bent plates is coupled with the magnetic disc by a transition fit or a loose fit. Based on this, the magnetic disc can be smoothly disposed in the compartment, improving the convenience in assembly.

In the form shown, the compartment has a portion away from the magnetic top face and in an expanding form. Based on this, the magnetic disc can be smoothly disposed in the compartment, improving the convenience in assembly.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
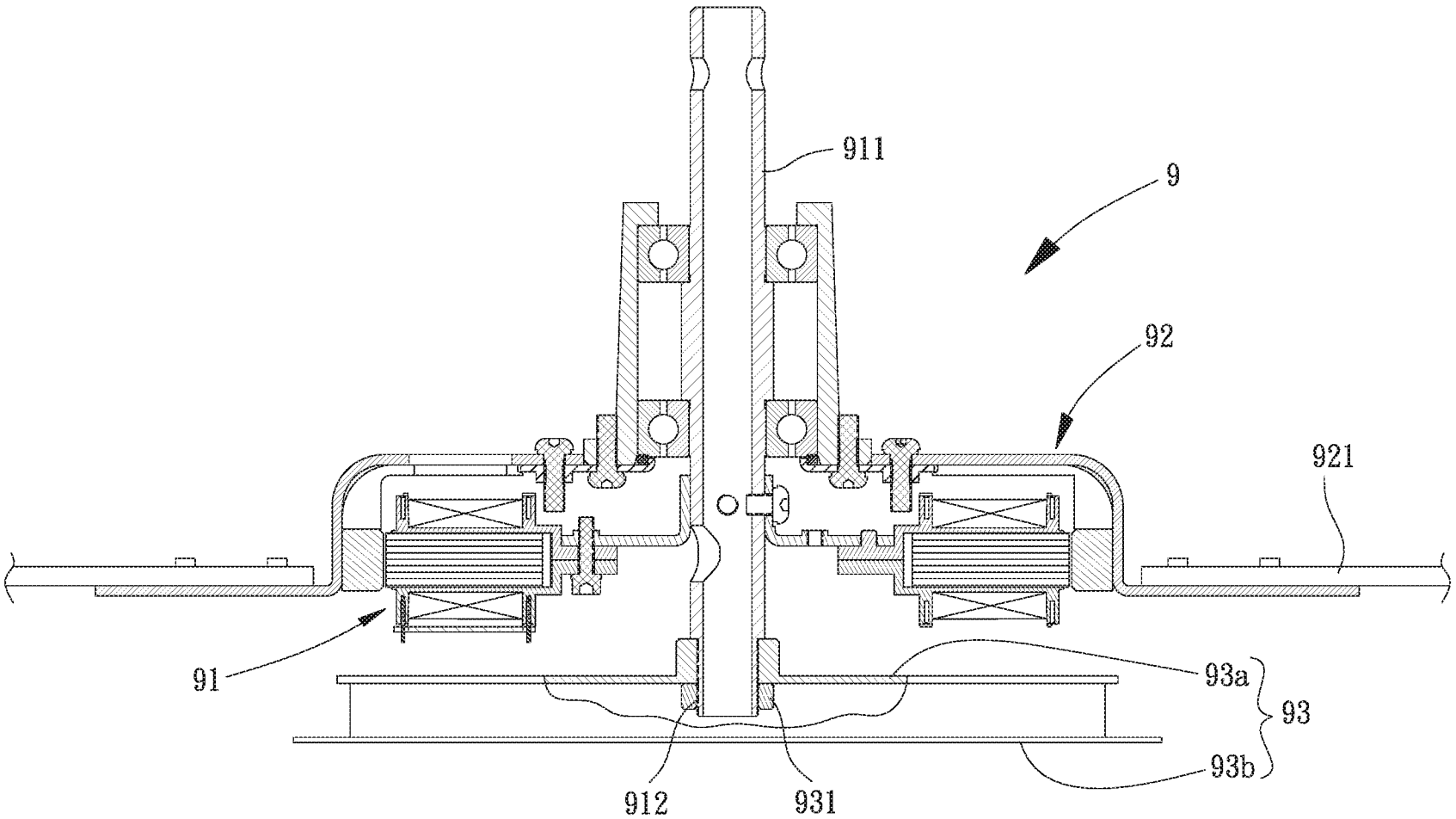
FIG. 1 PRIOR ART
FIG. 1 is a cross sectional view of a conventional fan.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
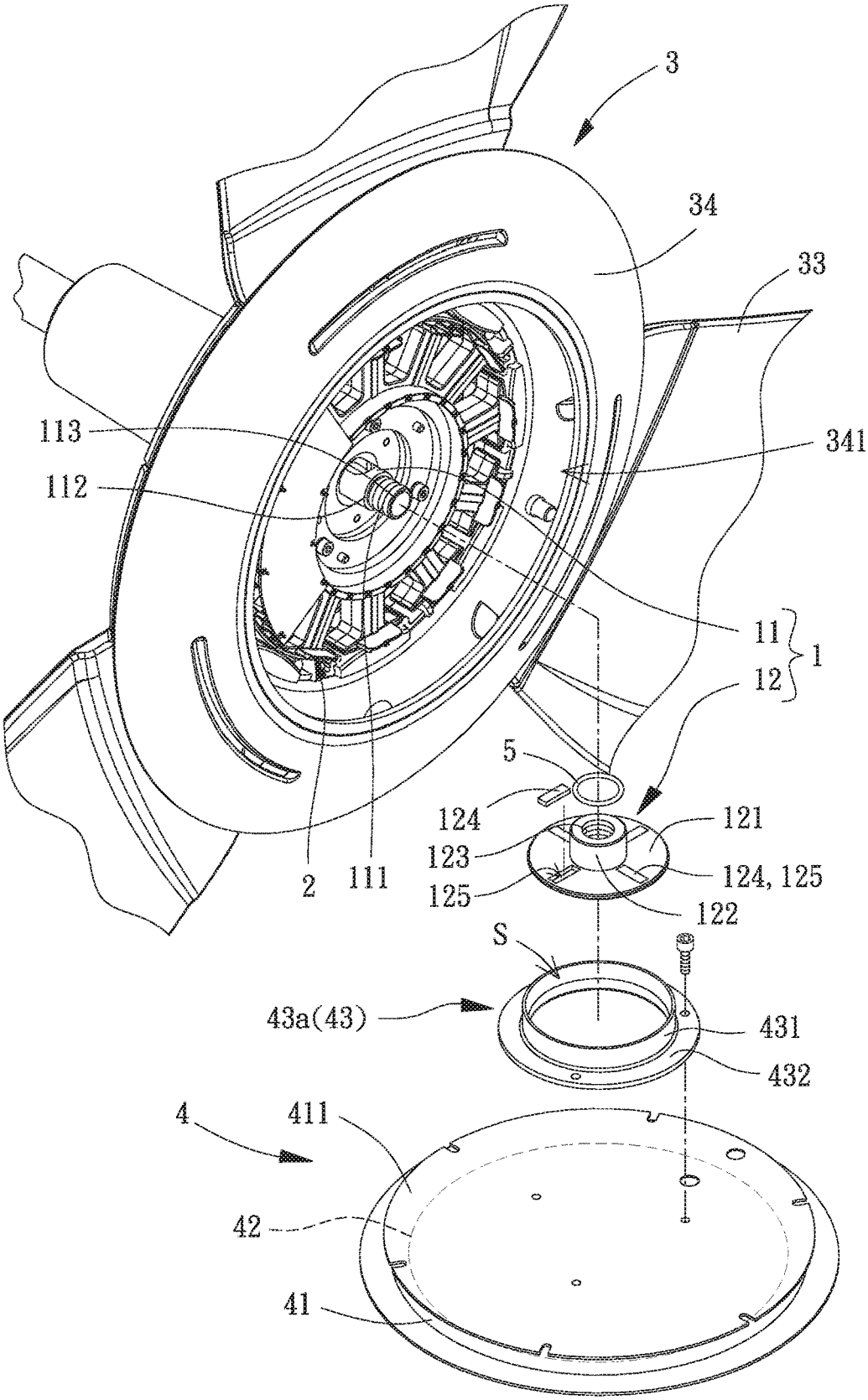
FIG. 2 is an exploded view of a ceiling fan according to a first embodiment of the invention.
Figure 3:
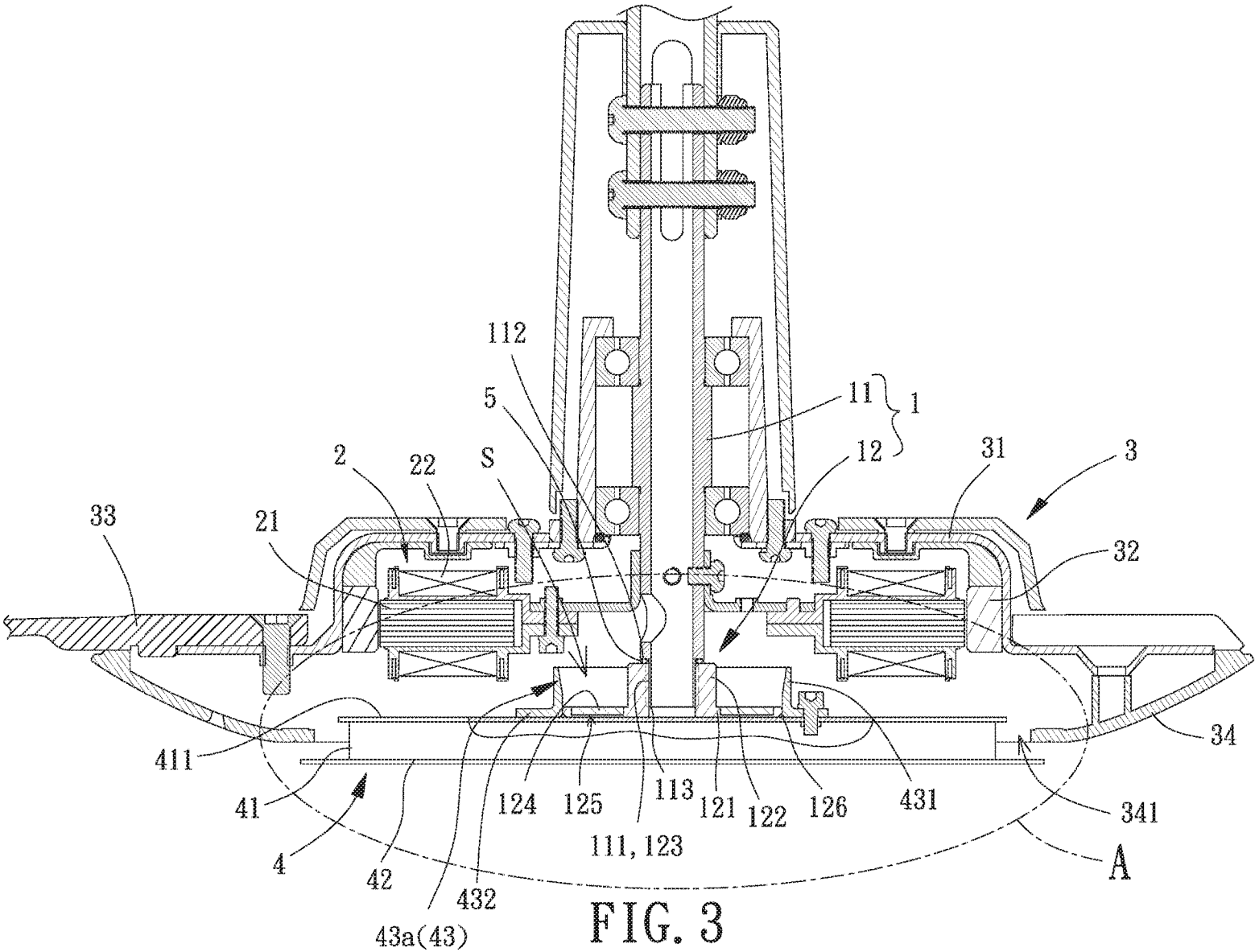
FIG. 3 is a cross sectional view of the ceiling fan of the first embodiment of the invention.

FIGS. 2 and 3 show a ceiling fan according to a first embodiment of the invention. The ceiling fan includes a support unit 1, a stator 2, a rotor 3 and a lamp 4. The stator 2 and the rotor 3 are fit around the outer periphery of the support unit 1. The lamp 4 is attracted to the bottom of the support unit 1.

The support unit 1 includes an axle 11 that may be hollow. The top of the axle 11 is directly or indirectly fixed to a predetermined location such as the ceiling, thereby hanging the fan from the ceiling and causing the air to flow in the space. The support unit 1 further includes a magnetic disc 12 fit around the axle 11. The magnetic disc 12 is preferably located at the bottom of the axle 11 to attract the lamp 4. In order to ensure a smooth fit between the magnetic disc 12 and the axle 11, the magnetic disc 12 is mounted to the bottom of the axle 11 preferably in a detachable manner instead of integral connection. The connecting mechanism between the magnetic disc 12 and the axle 11 is not limited in the present invention. In this embodiment, a first threaded portion 111 is provided on the outer periphery of the axle 11 at the bottom end thereof for threaded engagement with the magnetic disc 12.

Figure 4:
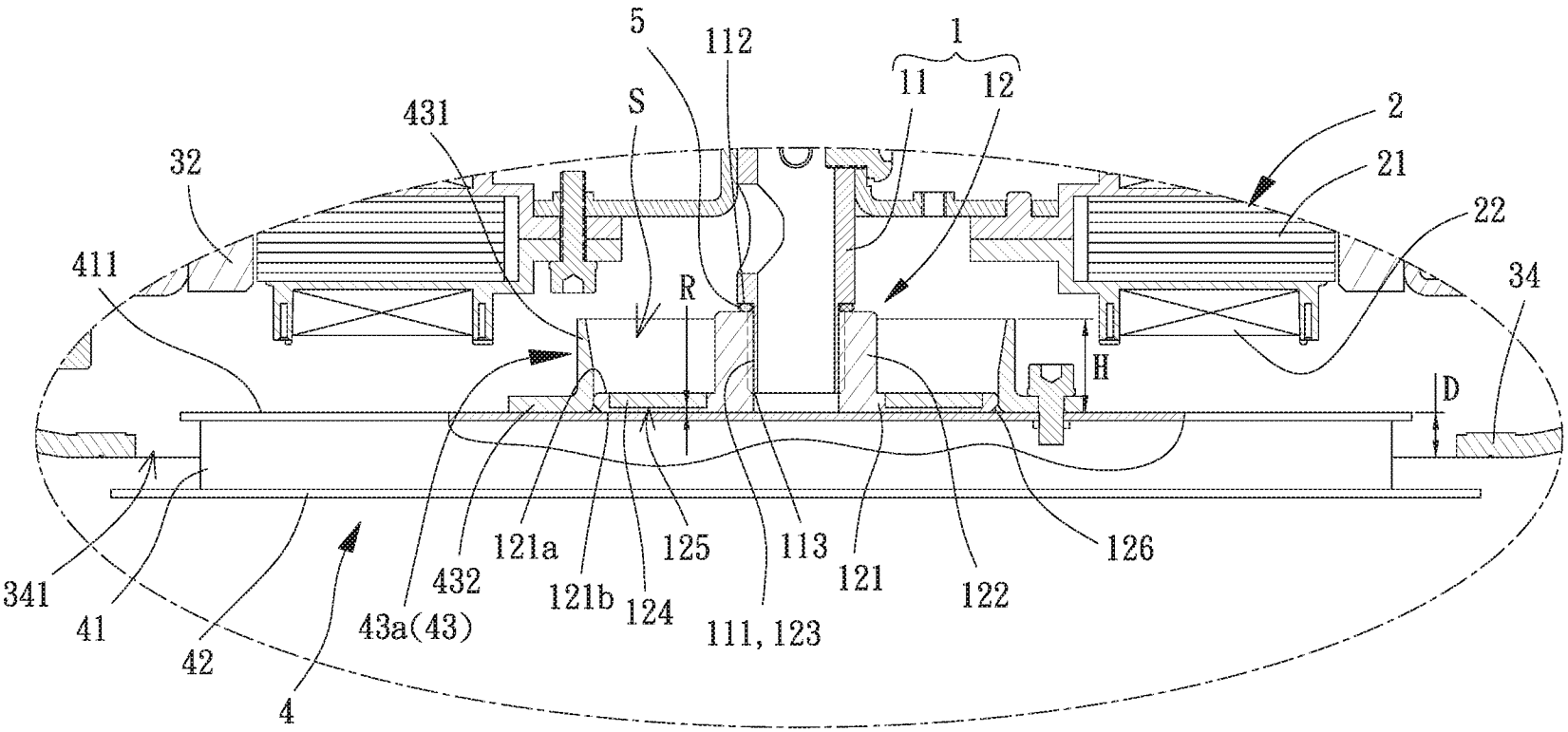
FIG. 4 is an enlarged view of a portion A of FIG. 3.

Specifically, referring to FIGS. 2 and 4, the magnetic disc 12 includes a disc portion 121 fit around the axle 11. The disc portion 121 includes a top face 121*a* and a bottom face 121*b* opposite to the top face 121*a*. The top face of the lamp 4 abuts the bottom face 121*b* of the magnetic disc 12. For example, the disc portion 121 is in an annular form having an inner periphery fitting around the bottom end of the axle 11. Alternatively, the top face 121*a* of the disc portion 121 forms a hole (not extending through the disc portion 121) through which the disc portion 121 can be engaged with the axle 11. Other configurations are also possible. The present invention is not limited to either option.

To reinforce the engagement between the disc portion 121 and the axle 11, the magnetic disc 12 in this embodiment further includes an extension tube 122 provided at the center of the top face 121*a* of the magnetic disc 12. The inner periphery of the extension tube 122 is provided with a second threaded portion 123 for more secure engagement with the first threaded portion 111 of the axle 11. In another embodiment, the first threaded portion 111 is provided on the inner periphery of the axle 11 at the bottom end thereof. In this case, the second threaded portion 123 is provided on the outer periphery of the extension tube 122 to achieve the same engagement effect.

Furthermore, the disc portion 121 in this embodiment is connected to the outer periphery of the extension tube 122. Each of two ends of the extension tube 122 forms an opening. The axle 11 includes a shoulder portion 112 with which an elastic member 5 is fit. The shoulder portion 112 is located adjacent to the first threaded portion 111. As such, when the extension tube 122 is coupled with the axle 11, the elastic member 5 is firmly sandwiched between the top of the extension tube 122 and the shoulder portion 112 of the axle 11 as it deforms elastically. Thus, the engagement between the magnetic disc 12 and the axle 11 is further reinforced. The elastic member 5 may be an O-ring or a spring washer. The present invention is not limited to either option.

Figure 5:
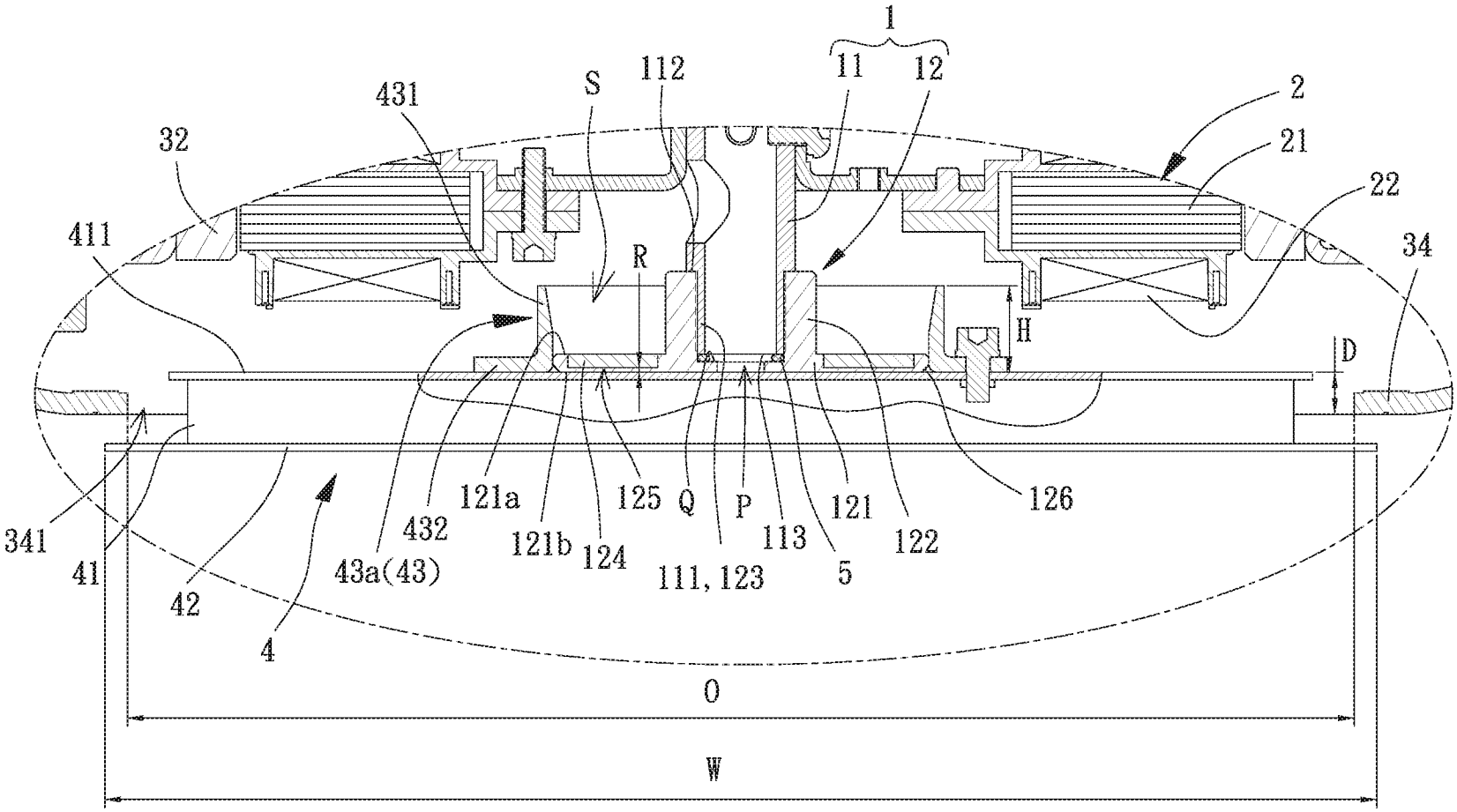
FIG. 5 is a partially-enlarged, cross sectional view of the ceiling fan including an elastic member mounted to the bottom end of the axle of the ceiling fan according to the first embodiment of the invention.

Alternatively, referring to FIG. 5, the disc portion 121 further includes a hole P having a diameter smaller than an inner diameter of the extension tube 122. Accordingly, a reduction portion Q forms between the hole P and the extension tube 122. The reduction portion Q is coaxial with the extension tube 122 and is at the bottom end of the second threaded portion 123 of the extension tube 122. The elastic member 5 is mounted on the reduction portion Q. As such, when the extension tube 122 is coupled with the axle 11, the elastic member 5 is firmly sandwiched between the reduction portion Q and a bottom end face 113 of the axle 11 as it deforms elastically.

Figure 6:
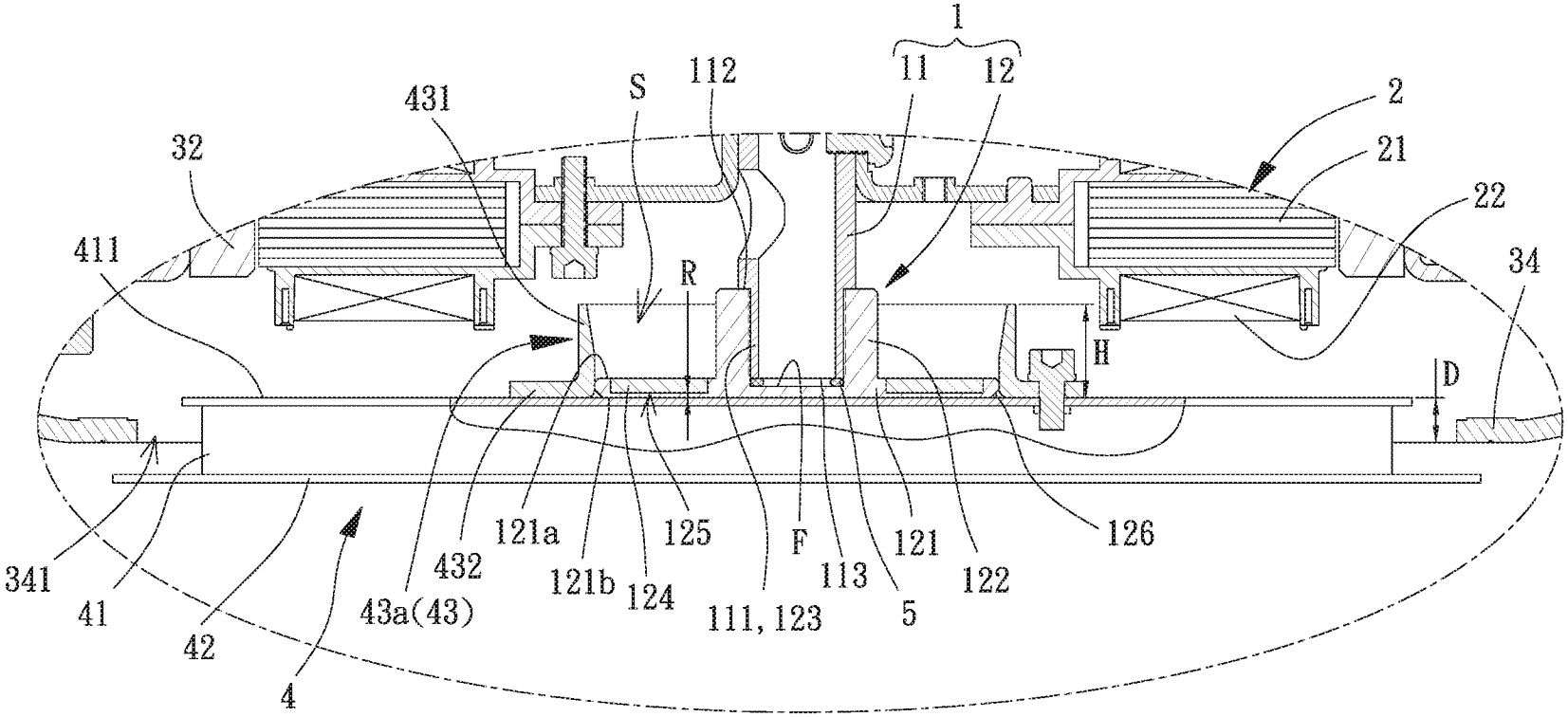
FIG. 6 is a partially-enlarged, cross sectional view of the ceiling fan having another type of the magnetic disc.

Alternatively, referring to FIG. 6, in another embodiment, when the disc portion 121 closes an end of the extension tube 122 to form a blind hole for the extension tube 122, the elastic member 5 can be firmly sandwiched between the top of the extension tube 122 and the shoulder portion 112 of the axle 11 as shown in FIG. 3, or can be disposed in the extension tube 122 in order to be firmly sandwiched between the bottom end face 113 of the axle 11 and a bottom face F of the extension tube 122 when the axle 11 is coupled with the extension tube 122 as shown in FIG. 6. This also reinforces the engagement effect between the magnetic disc 12 and the axle 11.

Furthermore, referring to FIGS. 2 and 4, the magnetic disc 12 further includes at least one magnet 124 mounted on the disc portion 121. In the case where the at least one magnet 124 includes a plurality of magnets 124, the plurality of magnets 124 attracts the lamp 4 through the magnetic force. The disc portion 121 and the extension tube 122 are preferably made of a metal material which is magnetically non-conductive such as aluminum in order not to adversely affect the magnetism of the plurality of magnets 124. As shown in FIGS. 2 and 4, the plurality of magnets 124 can be annularly arranged on the disc portion 121 with equal spacings to provide uniform magnetism. Alternatively, the at least one magnet 124 includes only a single magnet 124 which is in an annular form to provide uniform magnetism.

The magnet 124 preferably does not protrude beyond the top face 121*a* or the bottom face 121*b* of the disc portion 121 to thereby reduce the entire axial height of the engaged magnetic disc 12 and lamp 4. In this embodiment, at least one receiving space 125 forms on the disc portion 121 for installation of the magnet(s) 124. In a non-limiting example, each receiving space 125 forms in the top face 121*a* but does not extend through the disc portion 121 to the bottom face 121*b*. After the magnet(s) 124 is mounted in the receiving space(s) 125, the bottom of the magnet 124 is preferably spaced from the bottom face 121*b* of the disc portion 121 at a minimum axial distance R of 0.3-0.7 mm, ensuring that the magnet 124 will not drop from the bottom of the disc portion 121 while exhibiting a sufficient magnetic attraction force for the lamp 4. The outer periphery of the disc portion 121 may further include a tapering portion 126 tapering towards the bottom face 121*b*. The tapering portion 126 may be an inclined guiding face or an arched guiding face to provide a needed magnetic attraction effect between the magnetic disc 12 and the lamp 4.

Referring to FIGS. 2 and 3, the stator 2 includes an iron core 21 fit around the axle 11. A coil unit 22 is wound around the iron core 21.

The rotor 3 is rotatably coupled with the axle 11 and includes a hub 31 having an inner periphery mounted with a permanent magnet unit 32. The permanent magnet unit 32 is spaced from the iron core 21 of the stator 2 to form an air gap for the magnetic induction purposes. A plurality of blades 33 is mounted to the hub 31 to permit synchronous rotation of the hub 31 and the plurality of blades 33. A decorative cover 34 is mounted to the bottom of the rotor 3 and forms an installation opening 341 on the bottom of the rotor 3. The installation opening 341 is coaxial with the magnetic disc 12 for the installation purpose of the lamp 4. The installation opening 341 has a diameter larger than the size of the top portion of the lamp 4 but smaller than the size of the bottom portion of the lamp 4. Thus, the user will only see the plurality of blades 33, the lamp 4 and the decorative cover 34 when viewed from the bottom up and will not see the stator 2, the hub 31 and the permanent magnet unit 32. As such, the structure of the ceiling fan looks simpler and better while possessing the ability to prevent the intrusion of the foreign debris such as dust.

The lamp 4 includes a housing 41 having a magnetic top face 411. The diameter of the magnetic top face 411 is smaller than the installation opening 341 such that the magnetic top face 411 of the housing 41 can pass through the installation opening 341. The magnetic top face 411 is made of a metal material with magnetic conductivity such as iron, permitting the lamp 4 and the magnetic disc 12 to be attracted to each other through the magnetic top face 411. In this embodiment, the magnetic top face 411 can abut the bottom face 121*b* of the disc portion 121 to securely fix the magnetic disc 12 and to reduce the axial height of the ceiling fan after assembly.

The lamp 4 further includes a light emitting portion 42 below the magnetic top face 411. The light emitting portion 42 includes a light emitting device (LED), a power cord and a lampshade to provide the lamp 4 with an illumination function. This can be readily appreciated by the skilled person and therefore is not discussed herein for brevity. The width W of the bottom of the light emitting portion 42 is preferably larger than the diameter O of the installation opening 341 to provide a better look and a dustproof function. The bottom of the light emitting portion 42 has a radially outward portion which forms by extending the outer periphery of the bottom of the lampshade radially outward or by extending the outer periphery of the housing 41 downward and then radially outward. The present invention is not limited to either option.

Besides, the lamp 4 further includes a guiding protrusion 43 connecting to and protruding from the magnetic top face 411. Thus, after the lamp 4 is installed into the installation opening 341 of the rotor 3, the lamp 4 can be properly mounted to a predetermined location of the magnetic disc 12 as guided by the guiding protrusion 43. This ensures that the lamp 4 can be mounted to the bottom of the ceiling fan at the central position.

It is noted that, referring to FIG. 4, the installation opening 341 is spaced from the bottom face 121*b* of the magnetic disc 12 at an axial distance D. In this regard, the guiding protrusion 43 protrudes from the magnetic top face 411 by a maximum axial height H preferably larger than the axial distance D. Based on this, when the top portion of the lamp 4 passes through the installation opening 341 of the rotor 3, the guiding protrusion 43 may make contact with the magnetic disc 12 before the magnetic top face 411 makes contact with the magnetic disc 12. In this arrangement, the installer can smoothly proceed with the installation of the lamp 4 under the guidance of the guiding protrusion 43 without being able to view the magnetic disc 12, mounting the lamp 4 to the bottom of the ceiling fan at the central position.

Referring to FIGS. 2 and 4 again, in this embodiment, the guiding protrusion 43 is in the form of a ring 43*a* connecting to and protruding from the magnetic top face 411 of the housing 41. The ring 43*a* includes an annular wall 431 delimiting a compartment S for accommodation of the magnetic disc 12. The portion of the annular wall 431 that is connected to the magnetic top face 411 can couple with the magnetic disc 12 by a transition fit or a loose fit. Namely, the inner diameter of the annular wall 431 is preferably equal to or slightly larger than the outer diameter of the disc portion 121. The annular wall 431 preferably has increasing inner diameters at the end away from the magnetic top face 411. The ring 43*a* may be made of plastic material in which the magnetic top face 411 forms a plurality of engaging portions to be enveloped by the annular wall 431 of the ring 43*a* in injection molding. Alternatively, the ring 43*a* includes an end flange 432 connected to the outer periphery of the annular wall 431 as shown in FIG. 3, permitting the end flange 432 of the ring 43*a* to be fixed to the magnetic top face 411 via plural fasteners such as bolts. The present invention is not limited to either option.

Based on the above structure, referring to FIG. 3, during assembly of the ceiling fan of the first embodiment of the invention, the magnetic top face 411 of the lamp 4 is held towards the installation opening 341 of the rotor 3. Then, the lamp 4 is pushed upward such that the ring 43*a* of the lamp 4 makes contact with the magnetic disc 12 first as the top portion of the lamp 4 is inserted into the installation opening 341. In this regard, it simply requires the installer to slightly adjust the position of the lamp 4 by feel when the ring 43*a* makes contact with the magnetic disc 12 to thereby fit the magnetic disc 12 in the compartment S along the ring 43*a* through the arrangement of the expanding opening (having increasing inner diameters) of the annular wall 431 and the tapering portion 126 of the disc portion 121. Thus, under the force of attraction of the magnetic disc 12, the magnetic top face 411 of the housing 41 is attracted to the bottom of the magnetic disc 12. As a result, the installation of the lamp 4 is fast, mounting the lamp 4 to the bottom of the ceiling fan at the central position.

Figure 7:
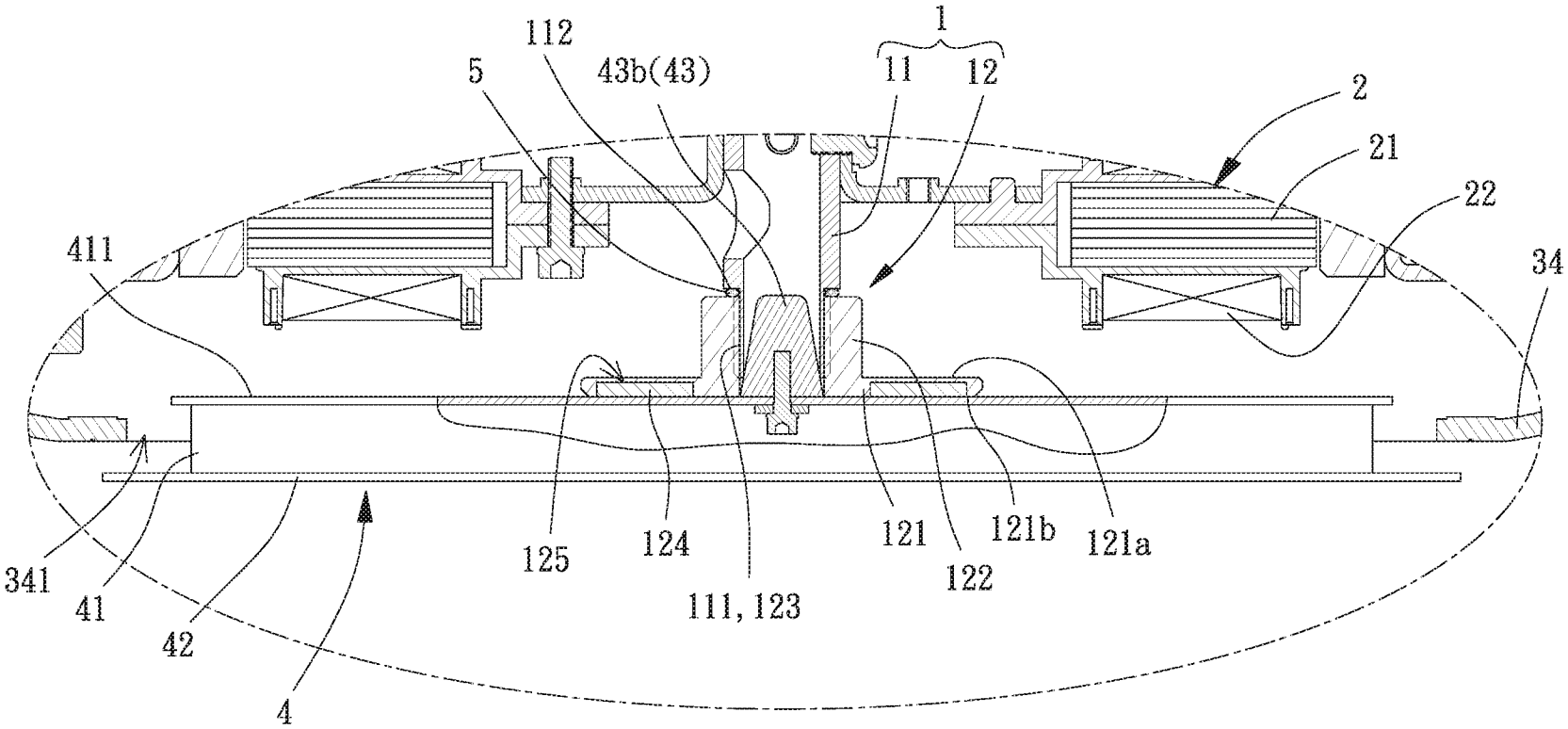
FIG. 7 is a partially-enlarged, cross sectional view of a ceiling fan according to a second embodiment of the invention.

FIG. 7 shows a ceiling fan according to a second embodiment of the invention. The second embodiment is substantially identical to the first embodiment except for the structure of the receiving space 125 and the guiding protrusion 43.

Specifically, the receiving space 125 of the magnetic disc 12 in this embodiment forms in the bottom face 121*b* but does not extend through the disc portion 121 to the top face 121*a*. In this arrangement, the magnets 124 and the magnetic top face 411 of the lamp 4 directly face each other, allowing the omission of a spacer material between the plurality of magnets 124 and the magnetic top face 411 of the lamp 4 and permitting the use of the magnets 124 with a weaker force. Advantageously, the cost of the ceiling fan can be reduced.

In another aspect, the guiding protrusion 43 of the embodiment may be a plug 43*b*. The plug 43*b* engages with and protrudes beyond the magnetic top face 411 for insertion into the hole delimited by the inner periphery of the axle 11 or the magnetic disc 12. Besides, the portion of the plug 43*b* away from the magnetic top face 411 is preferably in a tapered form to provide a smooth insertion of the plug 43*b* into the axle 11 or the magnetic disc 12.

Based on the above structure, during the installation of the lamp 4 according to a second embodiment of the present invention, the plug 43*b* of the lamp 4 may make contact with the magnetic disc 12 first when the top portion of the lamp 4 passes through the installation opening 341. In this situation, it simply requires the installer to slightly adjust the position of the lamp 4 by feel when the plug 43*b* makes contact with the magnetic disc 12 to thereby insert the plug 43*b* into the axle 11 or the magnetic disc 12 along the peripheral wall of the plug 43*b*. In this regard, the magnetic top face 411 is attracted to the bottom of the magnetic disc 12 through the force of attraction of the magnetic disc 12 to quickly complete the installation of the lamp 4, thereby mounting the lamp 4 underneath the center of the ceiling fan.

Figure 8:
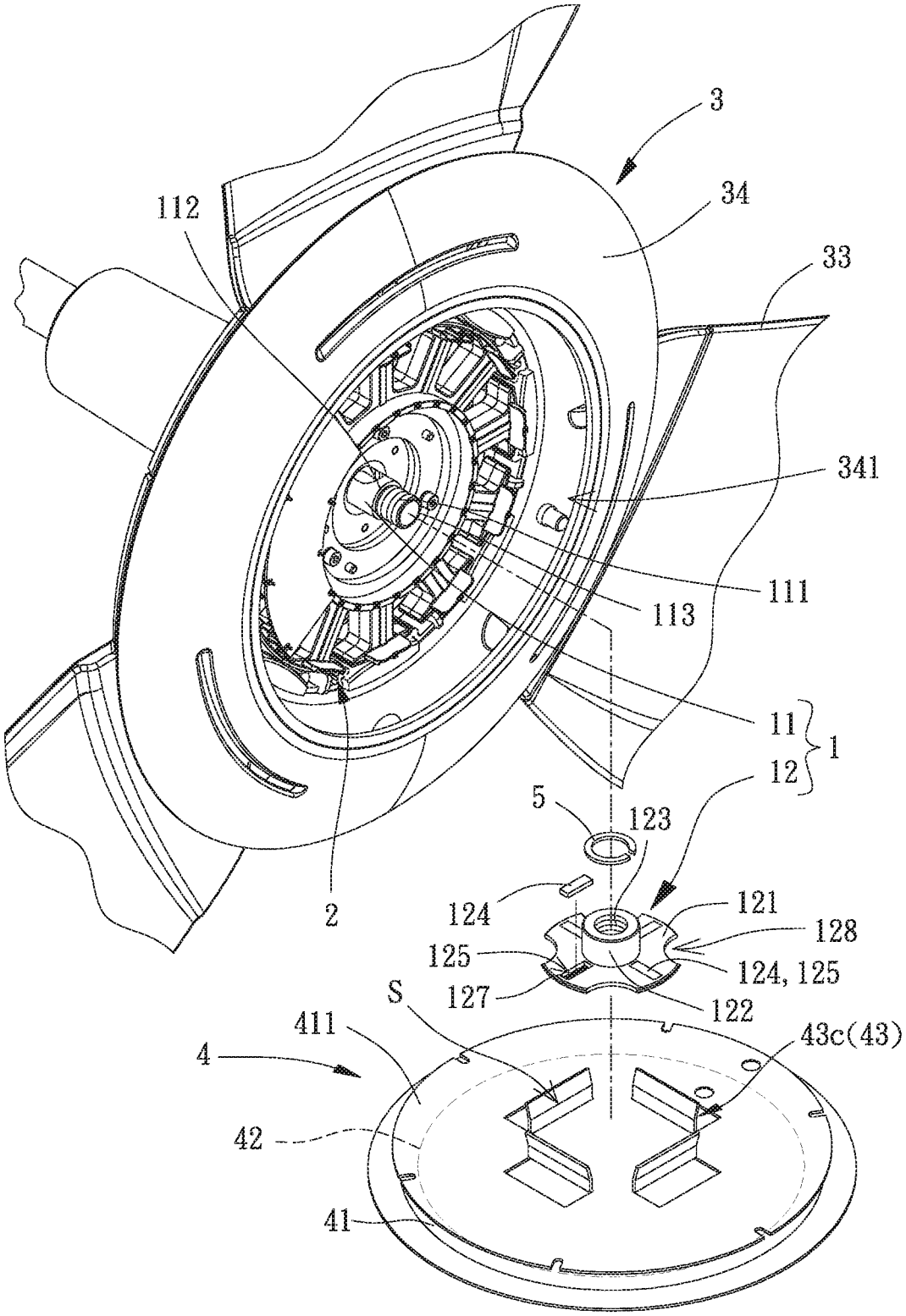
FIG. 8 is an exploded view of a ceiling fan according to a third embodiment of the invention.
Figure 9:
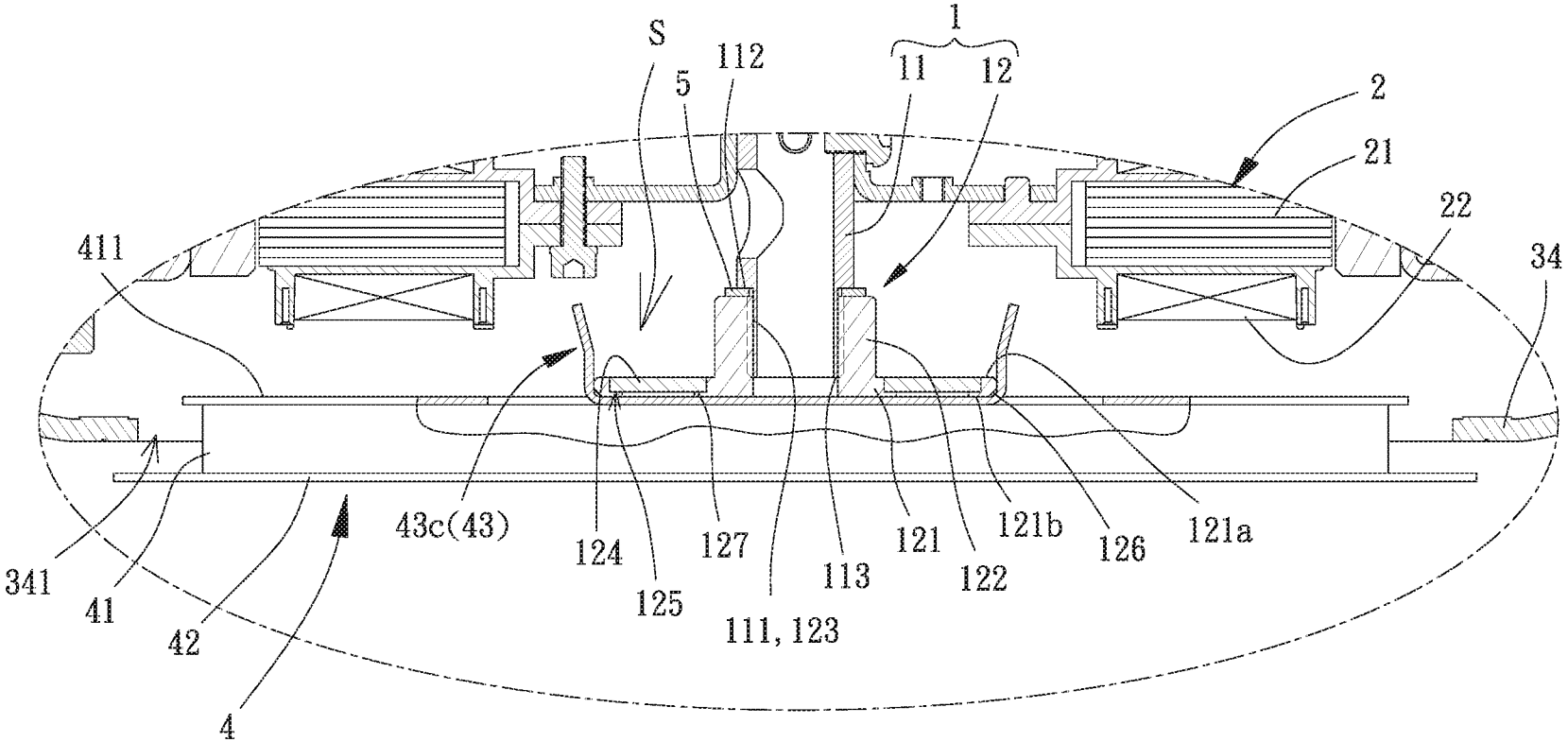
FIG. 9 is a partially-enlarged, cross sectional view of the ceiling fan of the third embodiment of the invention.

FIGS. 8 and 9 show a ceiling fan according to a third embodiment of the present invention. The third embodiment of the present invention is substantially the same as the first embodiment except for the configuration of the receiving space 125 and the guiding protrusion 43.

Specifically, the receiving space 125 in this embodiment may extend through the disc portion 121 from the top face 121*a* to the bottom face 121*b*. In addition, a shoulder portion 127 forms in the receiving space 125 such that the bottom of the magnet 124 abuts the shoulder portion 127 after the magnet 124 is received in the receiving space 125, ensuring that the magnet 124 will not drop from the bottom of the magnetic disc 12 while exhibiting a proper force of attraction to the lamp 4. Besides, as compared with the disc portion 121 of the first embodiment, the disc portion 121 in this embodiment can have a reduced weight.

In another aspect, the guiding protrusion 43 in this embodiment is in the form of a plurality of bent plates 43*c* that is formed by a punching process and is integrally connected to the magnetic top face 411. The plurality of bent plates 43*c* is so arranged to delimit a compartment S for receiving the magnetic disc 12. Each of the plurality of bent plates 43*c* has a bent portion contiguous with the magnetic top face 411. The bent portions of the plurality of bent plates 43*c* delimit an area whose minimum width is preferably equal to or larger than a maximum diameter of the magnetic disc 12 (measured from the outer periphery). The compartment S has a portion away from the magnetic top face 411 and preferably in an expanding form to improve convenience in installation.

Based on the above structure, during the installation of the lamp 4 according to a third embodiment of the invention, the plurality of bent plates 43*c* can make contact with the magnetic disc 12 first when the top portion of the lamp 4 is inserted into the installation opening 341. In this regard, it simply requires the installer to slightly adjust the position of the lamp 4 by feel when the plurality of bent plates 43*c* makes contact with the magnetic disc 12 to thereby fit the magnetic disc 12 in the compartment S along the surfaces of the plurality of bent plates 43*c* through the arrangement of the expanding end of the compartment S (having increasing inner diameters) and the tapering portion 126 of the disc portion 121. Thus, under the force of attraction of the magnetic disc 12, the magnetic top face 411 of the housing 41 is attracted to the bottom of the magnetic disc 12. As a result, the lamp 4 can be quickly mounted to the bottom of the ceiling fan at the central position.

Besides, as compared with the first embodiment where the ring 43*a* serves as the guiding protrusion 43 (referring to FIG. 2), the guiding protrusion 43 that forms from the plurality of bent plates 43 can further reduce the axial height and the weight of the lamp 4. In addition, when the plurality of bent plates 43*c* is made of the same material as the magnetic top face 411, the plurality of bent plates 43*c* can also be attracted to the plurality of magnets 124. This reinforces the engagement effect between the lamp 4 and the magnetic disc 12.

Furthermore, in the second and third embodiments above, the location of the elastic member 5 can be changed based on whether a through-hole or a blind hole forms between the disc portion 121 and the extension tube 122. The arrangement of the through-hole or the blind hole can be appreciated by the person skilled in the art and can be realized according to the requirement. Thus, the present invention is not limited to what is disclosed in the drawing.

Figure 10:
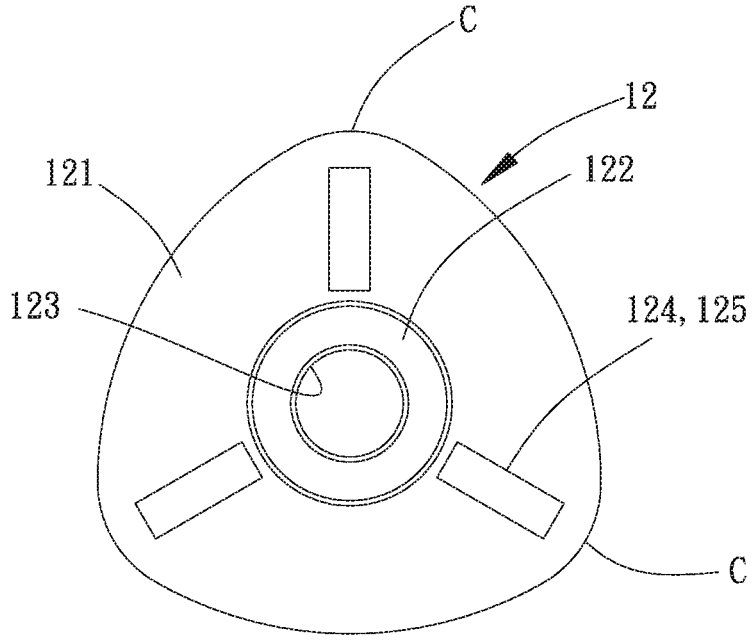
FIG. 10 shows a further type of the magnetic disc.
Figure 11:
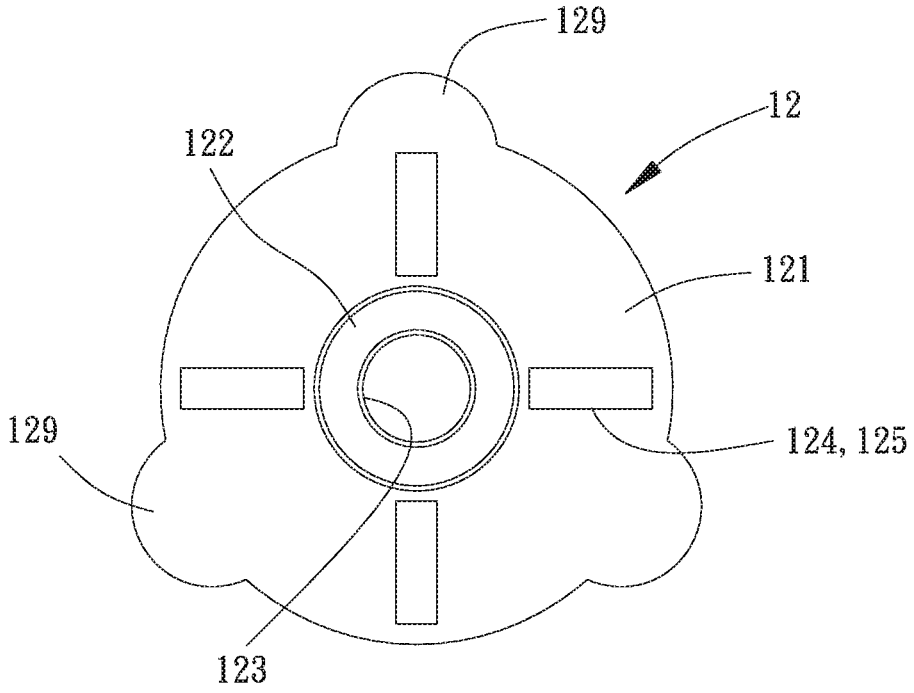
FIG. 11 shows a still further type of the magnetic disc.

Referring to FIGS. 8, 10 and 11, the disc portion 121 of the magnetic disc 12 in various embodiments of the present invention can be configured in a circular shape. In the example of FIG. 8, the outer periphery of the disc portion 121 can have at least one notch 128 without changing the maximum diameter of the disc portion 121. Each notch 128 is preferably located between two adjacent magnets 124 such that the arrangement of the at least one notch 128 does not affect the arrangement of the plurality of magnets 124, nor does it affect the engagement between the magnetic disc 12 and the guiding protrusion 43 of the lamp 4. In this regard, due to the non-circular shape of the disc portion 121, the disc portion 121 can be readily engaged with the axle 11 with less effort. In the example of FIG. 10, the disc portion 121 can be substantially in a polygonal shape, in which the corner portion C preferably has an arched outline to improve the yield rate in formation and the safety in operation. The disc portion 121 in FIG. 11 forms a plurality of projections 129 along the outer periphery thereof to similarly attain the easiness of engagement under less effort as the above implementations.

According to the above, the lamp of the ceiling fan of the present invention can be pre-assembled. The pre-assembled lamp can be brought to the installation site and the top portion of the lamp can be quickly mounted to the magnetic disc through the force of attraction to efficiently complete the assembly. This reduces not only the quantity of the parts requiring assembly but also the time consumption resulting from the assembly of said parts. As a result, the efficiency and convenience in assembly are greatly improved. In this regard, when the lamp requires repair or maintenance, the lamp can be quickly removed from the ceiling fan to thereby accomplish the advantage such as efficient replacement or maintenance.

Moreover, the top of the ceiling fan according to the present invention can include a guiding protrusion along which the lamp can be guided during the assembly to quickly align and properly mount the lamp to a predetermined location of the magnetic disc without tilting. As such, the installation of the lamp simply requires a few simple steps without having to adjust the position of the lamp or even to de-install the lamp for re-installation after the lamp is mounted to the magnetic disc. Thus, the efficiency of the assembly is improved.

In addition, although different shapes of the receiving space have been disclosed above, it is to be noted that each configuration of the receiving space is applicable to any of the embodiments disclosed, as it can be readily appreciated by one of ordinary skill in the art. Thus, the present invention is not limited to the figures corresponding to the embodiments.

Although the invention has been described in detail with reference to its presently preferable embodiments, it will be understood by one of ordinary skill in the art that various modifications can be made without departing from the spirit and the scope of the invention, as set forth in the appended claims

What is claimed is:

1. A ceiling fan comprising:

a support unit including an axle and a magnetic disc, wherein the magnetic disc includes a disc portion coupled with the axle and at least one magnet coupled with the disc portion of the magnetic disc, wherein a first threaded portion is provided at an end of the axle, wherein the magnetic disc includes an extension tube connected to a center of the magnetic disc on a face of the magnetic disc facing the axle, and wherein the extension tube includes a second threaded portion threadedly engaged with the first threaded portion of the axle;

a stator fit around the axle;

a rotor having a plurality of blades rotatably mounted to the axle; and a lamp including a housing and a light emitting portion below a magnetic top face of the housing, wherein the magnetic top face of the housing is attracted to the magnetic disc.

2. The ceiling fan as claimed in claim 1, wherein the disc portion of the magnetic disc is non-circular.

3. The ceiling fan as claimed in claim 1, wherein the axle includes a shoulder portion adjacent to the first threaded portion of the axle, and wherein an elastic member is sandwiched between a top of the extension tube and the shoulder portion of the axle.

4. The ceiling fan as claimed in claim 1, wherein the disc portion has a hole, wherein a reduction portion forms between the hole and the extension tube, wherein the reduction portion is coaxial with the extension tube and is at an end of the second threaded portion of the extension tube, and wherein an elastic member is sandwiched between the reduction portion and a bottom end face of the axle.

5. The ceiling fan as claimed in claim 1, wherein the disc portion is connected to an end of the extension tube to form a blind hole of the extension tube, wherein the elastic member is disposed in the extension tube and is sandwiched between the bottom end face of the axle and a bottom face of the extension tube.

6. A ceiling fan comprising:

a support unit including an axle and a magnetic disc, wherein the magnetic disc includes a disc portion coupled with the axle and at least one magnet coupled with the disc portion of the magnetic disc, wherein the disc portion has a top face and a bottom face opposite to the top face, wherein the disc portion forms at least one receiving space on the top face for installation of the at least one magnet, and wherein the at least one receiving space extends from the top face towards but spaced from the bottom face of the magnetic disc;

a stator fit around the axle;

a rotor having a plurality of blades rotatably mounted to the axle; and a lamp including a housing and a light emitting portion below a magnetic top face of the housing, wherein the magnetic top face of the housing is attracted to the magnetic disc, and wherein the magnetic top face abuts the bottom face of the disc portion of the magnetic disc.

7. The ceiling fan as claimed in claim 6, wherein the at least one magnet does not protrude from the top face or the bottom face, and wherein each of the at least one magnet has a bottom spaced from the bottom face of the disc portion at a minimum axial distance of 0.3-0.7 mm.

8. The ceiling fan as claimed in claim 6, wherein an outer periphery of the disc portion includes a tapering portion tapering towards the bottom face.

9. A ceiling fan comprising:

a support unit including an axle and a magnetic disc fit around the axle;

a stator fit around the axle;

a rotor having a plurality of blades rotatably mounted to the axle, wherein the rotor includes a decorative cover forming an installation opening; and a lamp including a housing and a light emitting portion below a magnetic top face of the housing, wherein the magnetic top face of the housing is attracted to the magnetic disc, wherein the lamp includes a guiding protrusion connected to and protruding from the magnetic top face, wherein the installation opening is spaced from a bottom face of the magnetic disc at an axial distance, wherein the guiding protrusion protrudes from the magnetic top face by a maximum axial height larger than the axial distance, and wherein the installation opening has a diameter larger than a diameter of the magnetic top face of the housing but smaller than a width of a bottom of the light emitting portion.

10. The ceiling fan as claimed in claim 9, wherein the guiding protrusion is in a form of a ring connecting to and protruding from the magnetic top face of the housing, wherein the ring includes an annular wall delimiting a compartment, and wherein the magnetic disc is received in the compartment.

11. The ceiling fan as claimed in claim 10, wherein the annular wall is coupled with the magnetic disc by a transition fit or a loose fit.

12. The ceiling fan as claimed in claim 10, wherein the compartment has a portion away from the magnetic top face and in an expanding form.

13. The ceiling fan as claimed in claim 9, wherein the axle is hollow, wherein the guiding protrusion is a plug engaging with and protruding beyond the magnetic top face, and wherein the plug is inserted into a hole of the axle or the magnetic disc.

14. The ceiling fan as claimed in claim 13, wherein the plug has a portion away from the magnetic top face and in a tapered expanding form.

15. The ceiling fan as claimed in claim 9, wherein the guiding protrusion is in a form of a plurality of bent plates integrally connected to the magnetic top face, and wherein the plurality of bent plates delimits a compartment receiving the magnetic disc.

16. The ceiling fan as claimed in claim 15, wherein the plurality of bent plates is coupled with the magnetic disc by a transition fit or a loose fit.

17. The ceiling fan as claimed in claim 15, wherein the compartment has a portion away from the magnetic top face and in an expanding form.

* * * * *